United States Patent [19]

Martikainen et al.

[11] 4,317,347

[45] Mar. 2, 1982

[54] CYLINDER LOCK

[75] Inventors: Kaarlo Martikainen; Paavo Piiroinen, both of Joensuu, Finland

[73] Assignee: Oy Wartsila Ab, Helsinki, Finland

[21] Appl. No.: 91,737

[22] Filed: Nov. 6, 1979

[30] Foreign Application Priority Data

Sep. 11, 1978 [FI] Finland ..... 783412

[51] Int. Cl.[3] ..... E05B 15/14; E05B 29/04

[52] U.S. Cl. ..... 70/366; 70/377

[58] Field of Search ..... 70/366, 365, 362, 377, 70/376, 392

[56] References Cited

U.S. PATENT DOCUMENTS 3,623,345 11/1971 Solitanner ..... 70/366

*Primary Examiner*—Robert L. Wolfe

*Attorney, Agent, or Firm*—McAulay, Fields, Fisher, Goldstein & Nissen

[57] ABSTRACT

A cylinder lock comprising a cylinder housing and therein a turnable cylinder enclosing a plurality of tumbler discs turnable by means of the key of the lock. Between the cylinder housing and the peripheral edges of the tumbler discs, there is a locking bar locking the cylinder to the cylinder housing. This bar is movable from a position locking the cylinder, in which position it is located partly in a groove in the internal wall of the cylinder housing, to a position releasing the cylinder by entering a channel formed jointly by notches in the peripheral edges of the tumbler discs when the discs are turned to a certain position. The movement of the locking bar is laterally guided by means of guiding discs, at least substantially non-rotatably fitted with respect to the cylinder. When the lock mechanism is fully released, the turning force transmitted by the key of the lock, is transmitted from the key to a tumbler disc, therefrom to the locking bar and from the locking bar to the guiding discs and through them to the cylinder.

8 Claims, 3 Drawing Figures

CYLINDER LOCK

Figure 1:
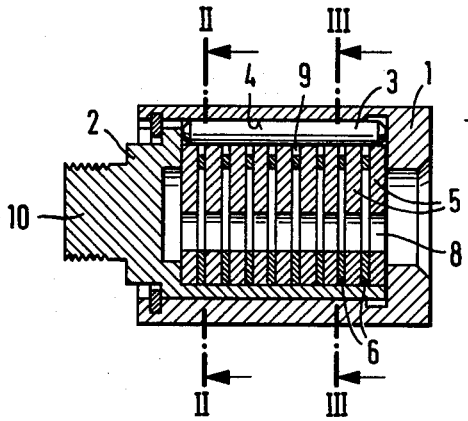

The invention relates to a cylinder lock of the kind comprising a cylinder housing, therein a turnable cylinder, wherein there is a plurality of tumbler discs turnable by means of the key of the lock, and, between the cylinder housing and the peripheral edges of the tumbler discs, a locking bar locking the cylinder to the cylinder housing, which bar is movable from a position locking the cylinder, in which position it is located partly in a groove in the internal wall of the cylinder housing, to a position releasing the cylinder by entering a channel formed jointly by notches in the peripheral edges of the tumbler discs when brought to a certain position.

There have been functional disturbances in conventional rotary disc-tumbler cylinder locks, for example, when a very heavy mechanism is to be moved by means of a cylinder lock. In other rotary disc-tumbler cylinder locks faulty releasing of the mechanism may occur. In general, functional disturbances occur because there are clearances in the lock, which in locks manufactured in mass production for practical reasons are relatively great and they have a harmful influence on the functional accuracy of the lock. This, in turn, results in that the lock in some special cases is not able to fully meet its requirements.

The object of the invention is to create an improved rotary disc-tumbler cylinder lock, in which, among other things, the force transmission from the key of the lock to a mechanism driven by the lock has been changed, so that the functional accuracy of the lock is improved. The invention is characterized in that the movement of the locking bar from the position locking the cylinder to the position releasing the cylinder, is laterally guided by means of guiding discs, at least substantially non-rotatably fitted with respect to the cylinder, so that when the lock mechanism is fully released, the turning force transmitted by the key of the lock, is transmitted from the key to a tumbler disc, therefrom to the locking bar and from the locking bar to said guiding discs and through them to the cylinder. It has been found that in this way a lock with a more accurate function is obtained, in which the clearances of the lock mechanism can be better controlled, and which functions perfectly also when subject to a heavy load.

In a lock according to the invention, conventional so called spacer discs, placed between the tumbler discs, can with advantage be used as guiding discs. Thereby, the advantage is obtained that no additional members are needed in the lock, but the members present in a conventional rotary disc-tumbler cylinder lock can be used as such.

In a conventional rotary disc-tumbler cylinder lock, the spacer discs are guided relative to the cylinder so that they have a radial protrusion fitting into an opening in the cylinder wall. In a lock according to the invention, the same design can be used, but then it is of advantage to have the radial recess guiding the locking bar in said radial protrusion of the guiding discs. Thereby, a better form is obtained for the spacer disc, and the whole lock construction is simplified.

A lock according to the invention can with advantage be further developed so that the actual force transmission from the lock mechanism to an outer mechanism driven thereby is not effected until a small initial rotation has been completed, which brings the parts of the lock mechanism into such a position that the lock is able to transmit even great turning forces. A lock functioning in this way is obtained, if the guiding discs of the locking bar are so arranged, that they are free to turn through a small angle relative to the cylinder, which angle is at least of a magnitude causing the locking bar to be pushed, due to said turning movement, out from the groove in the internal wall of the cylinder housing and is due to the influence of the unbroken internal cylinder surface of the cylinder housing, locked in a channel formed jointly in the released position of the lock by peripheral notches in the tumbler discs.

For carrying out the initial rotation a torque transmission from the tumbler discs to the guiding discs of the locking bar is necessary. This can be obtained in a known way, for example, so that one of the tumbler discs is non-rotatably coupled or connected to a guiding disc of the locking bar, or so that a slipping clutch according to Belgian Pat. No. 874288 is used. In some embodiments merely the internal friction of the tumbler disc set may be sufficient for obtaining the necessary initial torque.

In a conventional rotary disc-tumbler cylinder lock there are two openings in the wall of the cylinder, one for the locking bar and the other for the radial protrusions of the spacer discs and the tumbler discs. These two openings weaken the cylinder construction considerably, but in a lock according to the invention, the other opening can be totally eliminated and the other opening can be made considerably smaller. Due to this the cylinder construction will be stronger and considerably less yielding.

In a lock according to the invention, in which the guiding discs of the locking bar are free to move somewhat relative to the cylinder, as explained above, it is suitable to use a member, which yieldingly or completely limits the return movement of the cylinder. In this way it is made sure that the key is not by mistake turned back too far, so that it exceeds its withdrawal position.

Figure 2:
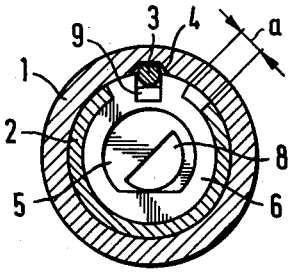
Figure 3:
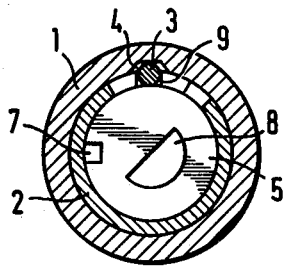

In the following, the invention will be described more in detail with reference to the attached drawing, in which FIG. 1 shows an axial section of a lock according to the invention, FIG. 2 shows a section taken on the line II—II in FIG. 1, FIG. 3 shows a section taken on the line III—III in FIG. 1.

In the drawing, numeral 1 indicates the cylinder housing of a lock mechanism and numeral 2 its turnable cylinder. The lock mechanism comprises a locking bar 3, which being partly in a groove 4 in the wall of cylinder housing 1 locks cylinder 2 to cylinder housing 1. The cylinder encloses a plurality of tumbler discs 5 and between them spacer discs 6. Every tumbler disc has at least one peripheral notch 7 (FIG. 3) and when a key, inserted into the keyway formed by central openings 8 of tumbler discs 5, is turned, its combination surfaces turn the separate tumbler discs so that peripheral notch 7 of each tumbler disc takes a position under locking bar 3 so that locking bar 3 is free to move radially inwardly into the channel jointly formed by said notches. Thereby, cylinder 2 is released and it can be rotated by turning said key further in the same direction.

In a lock according to the invention, there is no direct force transmission between cylinder 2 and locking bar 3 in any stage. In the embodiment shown in the drawing, the locking bar is guided by spacer discs 6 having a guiding slot 9. In principle also other members substantially non-rotatably fitted relative to cylinder 2 can be used for this purpose, for example, one guiding disc at both ends of the tumbler disc set, but since the spacer discs as such are well suitable for this purpose and they are used in this type of locks anyway, their use also for this purpose is of advantage.

In the embodiment shown in the drawing, spacer discs 6 are free to move relative to the cylinder a distance a, which is of such a magnitude that side bar 3, being partly in a channel formed by peripheral notches 7 in tumbler discs 5, can move in under the unbroken internal cylindrical surface of the cylinder housing, or, in other words, away from groove 4. Only after this small initial movement, force is transmitted from the key through the tumbler discs to locking bar 3 and therefrom to spacer discs 6 and through them to cylinder 2, the inner end 10 of which transmits the torque of the key further the mechanism driven by the lock. Consequently, when the torque of the key begins to have an effect on cylinder 2, locking bar 3 has already moved away from groove 4 and the unbroken internal cylindrical surface of the cylinder housing keeps the locking bar locked in its position as a member interlocking the whole tumbler and spacer disc set to one unit. In this way a very reliable force transmission from the key to the cylinder is obtained, which can withstand great loads.

The invention is not limited to the embodiment shown, but several variations of the invention are feasible within the scope of the attached claims.

What is claimed is:

1. In a cylinder lock comprising a cylinder housing, therein a hollow turnable cylinder, enclosing a plurality of tumbler discs turnable by means of the key of the lock, and, between said cylinder housing and the peripheral edges of said tumbler discs, a locking bar locking said cylinder to said cylinder housing, said bar being movable from a position locking said cylinder, in which position said bar is located partly in a groove in the internal surface of said cylinder housing, to a position releasing said cylinder, by entering a channel formed jointly by lined-up notches in the peripheral edges of said tumbler discs, wherein the improvement comprises:

guiding discs arranged at least substantially non-rotatably with respect to said cylinder for laterally guiding the movement of said locking bar from said groove into said channel and cooperating with said tumbler discs, said locking bar and said turnable cylinder to provide a path for transmission of a turning force, thereby providing means for transmitting, in a completely released position of the lock mechanism, the lock operating turning force of the key of the lock from said key to a tumbler disc, therefrom to said locking bar and from said locking bar to said guiding discs and through them to said cylinder.

2. In a lock according to claim 1, in which axially somewhat flexible spacer discs fitted between adjacent tumbler discs are used as guiding discs laterally guiding the movement of said locking bar.

3. In a lock according to claim 1 or 2, in which said guiding discs are kept in a certain turning position relative to said cylinder by means of an opening in the wall portion of said hollow cylinder and a radial protrusion in said guiding discs fitting into said opening, said protrusion having a radial recess guiding said locking bar laterally.

4. In a lock according to claim 1 or 2, in which said guiding discs are free to turn through a small angle relative to said cylinder, said angle being at least of a magnitude allowing said locking bar to leave said groove in the internal surface of said cylinder housing and take a position at the side of said groove.

5. In a lock according to claim 1 or 2, in which said hollow cylinder has a lateral slot, in which a radial protrusion of said guiding discs as well as said locking bar are located.

6. In a lock according to claim 1, in which there are means for limiting the return movement of said cylinder.

7. A cylinder lock, comprising:

a cylinder housing having an internal groove;

a hollow turnable cylinder including a plurality of key turnable tumbler discs, each of said discs having a notch in the peripheral edge thereof to form a channel when said notches are aligned;

a locking bar locking said cylinder to said cylinder housing, said bar being movable from a position located partly in said groove to a position into said channel;

guiding discs arranged at least substantially nonrotatably with respect to said cylinder; and cooperating means on said guiding discs and said hollow cylinder for laterally guiding the movement of said locking bar into said channel keeping said guiding discs and said cylinder in a certain relative turning position and for locking together said cylinder, said discs, said locking bar and said guiding discs to provide for, in a completely released position of the lock mechanism, means for transmitting a lock operating turning force from a lock key to said tumbler discs, then therefrom to said locking bar and therefrom to said guiding discs and therefrom to said cylinder;

said cooperating means includes:

an opening in a wall of said hollow cylinder, and a protrusion on said guiding discs fitting into said opening, said protrusion having a radial recess for laterally guiding said locking bar.

8. In a cylinder lock comprising a cylinder housing, therein a hollow turnable cylinder, enclosing a plurality of tumbler discs turnable by means of the key of the lock, and, between said cylinder housing and the peripheral edges of said tumbler discs, a locking bar locking said cylinder to said cylinder housing, said bar being movable from a position locking said cylinder, in which position said bar is located partly in a groove in the internal surface of said cylinder housing, to a position releasing said cylinder, by entering a channel formed jointly by lined-up notches in the peripheral edges of said tumbler discs, wherein the improvement comprises:

guiding discs having first force-transmitting means providing lateral force-transmitting contact with said locking bar and second force-transmitting means providing torque-transmitting contact with said cylinder, said tumbler discs being free of positive torque-transmitting contact surfaces cooperating with said cylinder, thereby providing, in a released position of the lock mechanism, a lock operating force transmission from the key of the lock to a number of tumbler discs, from them to said locking bar and from said locking bar over said first force-transmitting means to said guiding discs and through them over said second force-transmitting means to said cylinder.

* * * * *

UNITED STATES PATENT AND TRADEMARK OFFICE

CERTIFICATE OF CORRECTION

PATENT NO. : 4,317,347

DATED : March 2, 1982

INVENTOR(S) : Kaarlo Martikainen

It is certified that error appears in the above-identified patent and that said Letters Patent is hereby corrected as shown below:

On the title page, priority data should read

--(30) November 9, 1978 Finland 78-3412--.

Signed and Sealed this

*Twenty-sixth* Day of *April 1983*

[SEAL]

*Attest:*

GERALD J. MOSSINGHOFF

*Attesting Officer*

*Commissioner of Patents and Trademarks*